US010027070B1

(12) United States Patent
Timmons et al.

(10) Patent No.: US 10,027,070 B1
(45) Date of Patent: Jul. 17, 2018

(54) HVIL PLUG ASSEMBLY

(71) Applicants: Adam Timmons, Royal Oak, MI (US); Dale Somma, Chesterfield, MI (US)

(72) Inventors: Adam Timmons, Royal Oak, MI (US); Dale Somma, Chesterfield, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 15/444,454

(22) Filed: Feb. 28, 2017

(51) Int. Cl.
*H01R 13/703* (2006.01)
*H01R 13/53* (2006.01)
*H01R 13/642* (2006.01)

(52) U.S. Cl.
CPC ..... *H01R 13/7031* (2013.01); *H01R 13/53* (2013.01); *H01R 13/642* (2013.01)

(58) Field of Classification Search
CPC .... H01R 13/44; H01R 13/6215; H01R 31/08; H01R 31/085
USPC ..... 439/34, 362, 509, 511, 911
See application file for complete search history.

(56) References Cited

U.S. PATENT DOCUMENTS 3,737,591 A 6/1973 Parlato
5,306,156 A * 4/1994 Gibbs ..... B60Q 1/302 224/315
5,377,629 A 1/1995 Brackett et al.
5,792,247 A 8/1998 Gillingham et al.
7,084,361 B1 8/2006 Bowes et al.
7,497,196 B2 3/2009 Prior
7,586,722 B2 9/2009 Scholer et al.
8,043,108 B2 10/2011 Albert et al.
8,098,126 B2 1/2012 Niedzwiecki et al.
8,199,449 B2 6/2012 Kuschnarew et al.
8,734,191 B2 5/2014 Zhao
9,024,183 B2 * 5/2015 Sakakura ..... H01R 13/5202 174/50.5
9,318,826 B2 * 4/2016 Kato ..... B60L 11/14
9,397,459 B2 * 7/2016 Butcher ..... H01R 33/95
2008/0072863 A1 3/2008 Egawa et al.
2008/0135010 A1 6/2008 Prior
(Continued)

FOREIGN PATENT DOCUMENTS

CN 104793538 A 7/2015

OTHER PUBLICATIONS

International Search Report and Written Opinion dated Apr. 30, 2018 for International Application No. PCT/US2018/020161, Filing Date Feb. 28, 2018.

*Primary Examiner* — Tulsidas C Patel
*Assistant Examiner* — Marcus Harcum
(74) *Attorney, Agent, or Firm* — Ralph E Smith

(57) ABSTRACT

A high voltage interlock (HVIL) plug assembly includes a main body having an outer surface and an inner surface configured to be disposed against a cover of an electrical device, wherein removal of the cover enables access to components in the electrical device electrically connected to the high voltage interlock circuit, a jumper coupled to the main body and configured to extend through a receiving aperture in the cover to couple to the connector and establish circuit continuity when the main body is coupled to the cover, and a flange extending from the main body. When the main body is coupled to the cover, the flange covers and prevents access to a fastener that couples the cover to a housing of the electrical device such that the main body must be uncoupled and removed from the cover in order to remove the fastener and enable removal of the cover.

19 Claims, 6 Drawing Sheets

(56) References Cited

U.S. PATENT DOCUMENTS

| | | | | |
|---|---|---|---|---|
| 2010/0084205 | A1 | 4/2010 | Tarchinski et al. | |
| 2010/0255709 | A1 | 10/2010 | Tyler | |
| 2011/0127855 | A1 | 6/2011 | Kim | |
| 2012/0281342 | A1* | 11/2012 | Topolewski | H01R 31/08 361/679.01 |
| 2014/0127939 | A1* | 5/2014 | Ishibashi | H01R 13/6397 439/573 |
| 2014/0193990 | A1 | 7/2014 | Zhao et al. | |
| 2015/0207130 | A1 | 7/2015 | Maguire et al. | |

* cited by examiner

HVIL PLUG ASSEMBLY

FIELD

The present application relates generally to high voltage systems for vehicles and, more particularly, to a high voltage interlock (HVIL) plug with integrated fastener covers and mechanical seals.

BACKGROUND

Electric and hybrid electric vehicles typically include high voltage battery systems connected to components that operate at high voltage. For example, a manual service disconnect (MSD) is often used to disconnect a high current power circuit and enable a technician to safely service such high voltage battery systems or associated components. The MSD is typically associated with a high voltage interlock system (HVIL) having an HVIL control circuit to monitor the mechanical continuity of the connector to a host device or battery. Known HVIL systems include electrical switch devices to open an electric circuit to thereby prevent access to electrical components until current flow is prevented or discharged. However, such electrical switch devices are often expensive and bulky. Moreover, known HVIL systems include multiple separate components that complicate assembly and subsequent maintenance of the systems. Accordingly, while such known systems do work well for their intended purpose, it is desirable to provide an improved HVIL switch device integrating multiple components into a single piece housing.

SUMMARY

In one exemplary aspect of the invention, a high voltage interlock (HVIL) plug assembly configured to establish circuit continuity when coupled to a connector in a high voltage interlock circuit and prevent circuit continuity when decoupled from the connector is provided. In one exemplary implementation, the HVIL plug assembly includes a main body having an outer surface and an inner surface configured to be disposed against an access cover of an electrical device, wherein removal of the access cover enables access to components in the electrical device electrically connected to the high voltage interlock circuit, a jumper coupled to the main body and configured to extend through a receiving aperture in the access cover to couple to the connector and establish circuit continuity when the main body is coupled to the access cover, and a flange extending from the main body. When the main body is coupled to the access cover, the flange covers and prevents access to a fastener that couples the access cover to a housing of the electrical device such that the main body must be uncoupled and removed from the access cover in order to remove the fastener and enable removal of the access cover.

In addition to the foregoing, the described HVIL plug assembly may include one or more of the following features: a second flange extending from the main body, wherein when the main body is coupled to the access cover, the second flange covers and prevents access to a second fastener that couples the access cover to the housing such that the main body must be uncoupled and removed from the access cover in order to remove the second fastener and enable removal of the access cover; a fastener member disposed between the main body and the flange, the fastener member including a fastener aperture configured to receive a plug fastener to couple the main body to the access cover;

a first fastener member disposed between the main body and the flange, the first fastener member including a first fastener aperture configured to receive a first plug fastener to couple the main body to the access cover, and a second fastener member disposed between the main body and the second flange, the second fastener member including a second fastener aperture configured to receive a second plug fastener to further couple the main body to the access cover; an annular member disposed within the fastener aperture and configured to receive the plug fastener; wherein the jumper includes a jumper body and a key extending outwardly therefrom, the key configured to be received by a notch formed in the access cover receiving aperture to provide a proper orientation of the main body when the jumper is inserted through the receiving aperture; wherein the main body inner surface includes a seal configured to seal around the receiving aperture when the main body is coupled to the access cover; a structural rib extending outwardly from the main body outer surface; and a plurality of tabs arranged about a perimeter of the fastener aperture and extending outwardly from an outer surface of the fastener member.

In another exemplary aspect of the invention, an electrical device configured to electrically couple to a high voltage interlock circuit is provided. In one exemplary implementation, the electrical device includes a housing configured to house at least one electrical component electrically coupled to the high voltage interlock circuit, an access cover removably coupled to the housing by a fastener, wherein the access cover is removed to provide access to the at least one electrical component in the housing, the access cover having a receiving aperture formed therethrough, and a high voltage interlock (HVIL) system configured to selectively break continuity of the high voltage interlock circuit and remove high voltage from the electrical device. The HVIL system includes an HVIL connector disposed within the housing and electrically connected to the high voltage interlock circuit, and an HVIL plug assembly removably coupled to the HVIL connector. The HVIL plug assembly establishes circuit continuity when coupled to the HVIL connector, and breaks circuit continuity when uncoupled from the HVIL connector. The HVIL plug assembly includes a main body removably coupled to the access cover and having an outer surface and an inner surface configured to be disposed against the access cover, a jumper coupled to the main body and configured to extend through the access cover receiving aperture to couple to the connector and establish circuit continuity when the main body is coupled to the access cover, and a flange extending from the main body, wherein when the main body is coupled to the access cover, the flange covers and prevents access to the fastener that couples the access cover to the housing such that the main body must be uncoupled and removed from the access cover in order to remove the fastener and enable removal of the access cover.

In addition to the foregoing, the described electrical device may include one or more of the following features: a fastener member disposed between the main body and the flange, the fastener member including a fastener aperture configured to receive a plug fastener to couple the main body to the access cover; wherein the main body, the flange, the fastener member, and the jumper are integrally formed into a single component; a second flange extending from the main body, wherein when the main body is coupled to the access cover, the second flange covers and prevents access to a second fastener that couples the access cover to the housing such that the main body must be uncoupled and removed from the access cover in order to remove the second fastener and enable removal of the access cover; a first fastener member disposed between the main body and the flange, the first fastener member including a first fastener aperture configured to receive a first plug fastener to couple the main body to the access cover, and a second fastener member disposed between the main body and the second flange, the second fastener member including a second fastener aperture configured to receive a second plug fastener to further couple the main body to the access cover; wherein the main body, the flange, the second flange, the first fastener member, the second fastener member, and the jumper are integrally formed into a single component; a first annular member disposed within the first fastener aperture and configured to receive the first plug fastener, and a second annular member disposed within the second fastener aperture and configured to receive the second plug fastener; wherein the jumper includes a jumper body and a key extending outwardly therefrom, the key configured to be received by a notch formed in the access cover receiving aperture to provide a proper orientation of the main body when the jumper is inserted through the receiving aperture; wherein the main body inner surface includes a seal configured to seal around the receiving aperture and key when the main body is coupled to the access cover; and a plurality of tabs arranged about a perimeter of the fastener aperture and extending outwardly from an outer surface of the fastener member.

Figure 1:
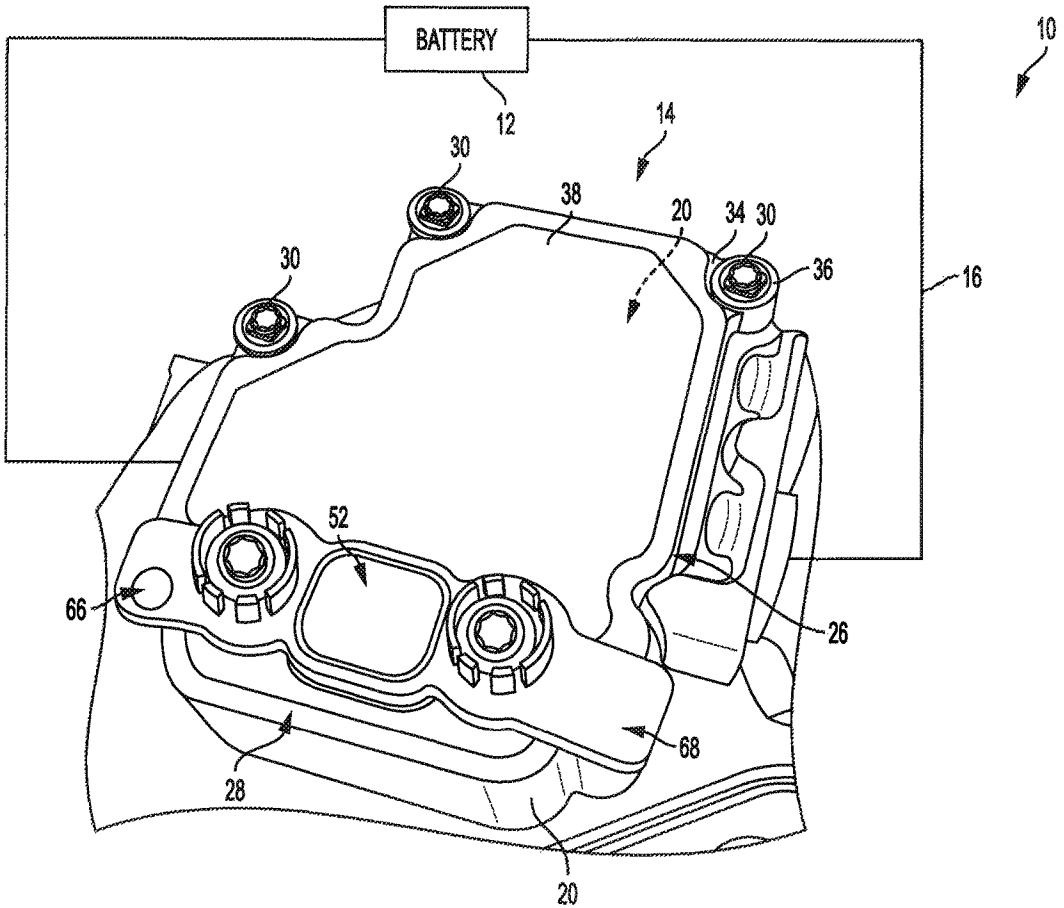
FIG. 1 is a perspective view of an example electrical device having a high voltage interlock (HVIL) system in accordance with the principles of the present application.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed implementations and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DESCRIPTION

With initial reference to FIG. 1, an example high voltage battery system is illustrated and generally identified at reference numeral 10. High voltage battery system 10 generally includes a battery pack 12 in electrical communication with one or more electrical accessories or devices 14 via a high voltage circuit 16. High voltage battery system 10 is associated with a vehicle such as an electric or hybrid electric vehicle. However, it will be appreciated that high voltage battery system 10 is configured for use in various other applications. Moreover, the systems described herein may be utilized with various other electrical systems and are not limited solely to high voltage electrical systems.

Figure 2:
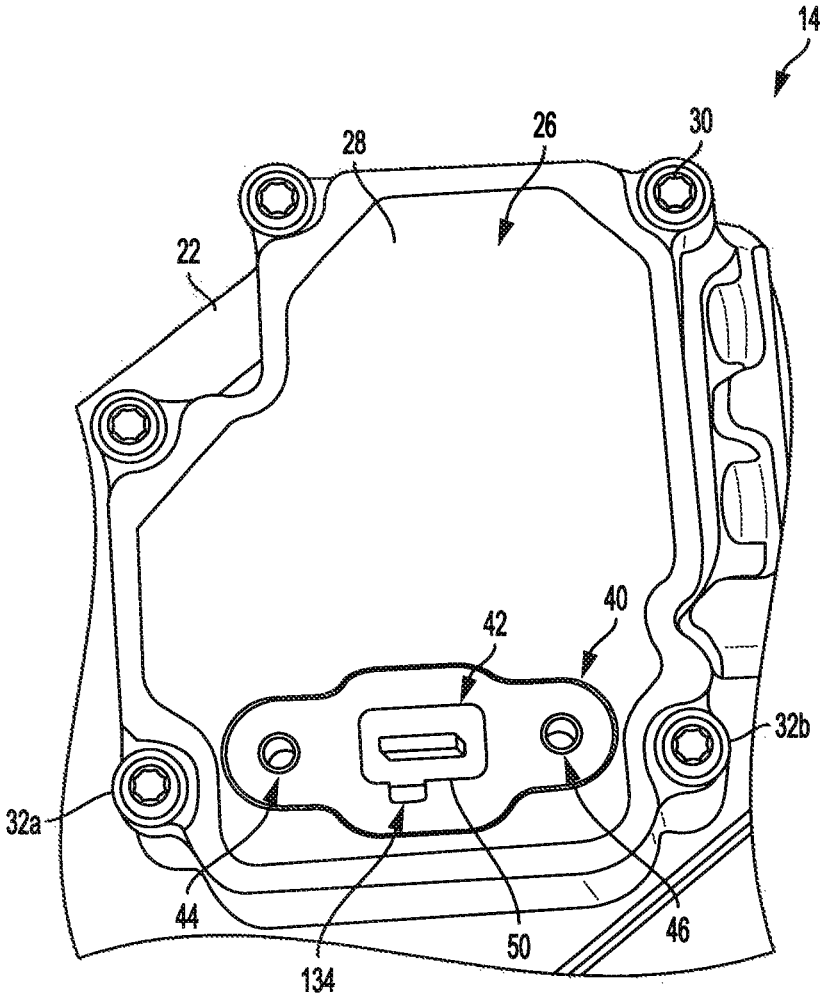
FIG. 2 is a perspective view of the electrical device shown in FIG. 1 with a plug of the HVIL system removed, in accordance with the principles of the present application.

In one example embodiment, FIGS. 1 and 2 illustrate electrical device 14 as including a power inverter module 20 configured to receive high voltage from battery pack 12 and provide high voltage AC to the vehicle motors (not shown), and subsequently collect high voltage AC from the motors and convert it back to DC for the battery pack 12. Electrical device 14 generally includes a housing 22 configured to house various electrical components such as inverter switching circuits and circuits that control the inverter switching through communications and microprocessing (not shown). However, electrical device 14 can include various other electrical components for various other applications.

In the example embodiment, electrical device 14 includes an access cover 26 removably coupled to housing 22 to enable access to at least some of the electrical components within housing 22 including high voltage electrical connections between device 14 and other high voltage devices when service is required. However, in order to safely service the components and prevent electrical shock, the electrical device 14 includes a high voltage interlock (HVIL) system 28 configured to remove high voltage from the electrical device 14 before a person can access the electrical components. More specifically, as described herein in more detail, HVIL system 28 automatically disconnects battery pack 12 from the high voltage battery system 10 before access cover 26 can be removed from housing 22, to provide access to the electrical components therein.

As shown in FIG. 2, access cover 26 is removably coupled to housing 22 by a plurality of fasteners 30, 32. Access cover 26 includes a plurality of flanges 34 each having an aperture 36 formed therein configured to receive one of the fasteners 30, 32. Moreover, an outer surface 38 of access cover 26 includes an inset 40 formed therein sized and shaped to receive a portion of the HVIL system 28. Additionally, a receiving aperture 42 and fastener apertures 44, 46 are formed in the cover and configured to receive portions of the HVIL system 28 therein, as described herein in more detail.

With additional reference to FIGS. 3 and 4, HVIL system 28 will be described in more detail. As shown in the figures, HVIL system generally includes an HVIL connector 50 (FIG. 2) configured to matingly engage an HVIL plug assembly 52 to establish HVIL circuitry continuity. The HVIL connector 50 is disposed within the device housing 22 and is electrically connected to the high voltage interlock circuit 16. In one example, the HVIL circuit 16 terminates discontinuously at the junctions of the female HVIL connector 50 into which male pins (e.g., 136 in FIG. 3) are inserted when HVIL plug assembly 52 is inserted in the receiving aperture 42 (FIG. 2) formed through access cover 26. When HVIL plug assembly 52 is inserted through receiving aperture 42 and coupled to HVIL connector 50, the circuit is completed and high voltage is supplied from battery pack 12 to the various electrical devices 14 via high voltage circuit 16. When HVIL plug assembly 52 is disconnected from HVIL connector 50, the HVIL circuit continuity is broken, and high voltage is subsequently removed from the region of the electrical device 14 such that service may be safely performed the region.

In one example implementation, when the HVIL circuit 16 is connected, and other unrelated criteria are met, such as the battery state of charge is determined to be in an acceptable range, a management system or controller (not shown) permits the presence of high voltage outside of the HV battery pack 12. When HVIL circuit 16 has any discontinuities, high voltage is not permitted outside of the HV battery pack 12. Although not shown, the presence of high voltage outside of battery pack 12 can be mediated by switches or contactors that are generally positioned between the battery cells and the battery high voltage wiring connector that connects the batter to wires that provide high voltage from the batter to other devices outside of the battery. When the contactors are open, high voltage is not provided outside of the battery, and when there is a discontinuity in HVIL circuit 16 the contactors are opened.

Figure 3:
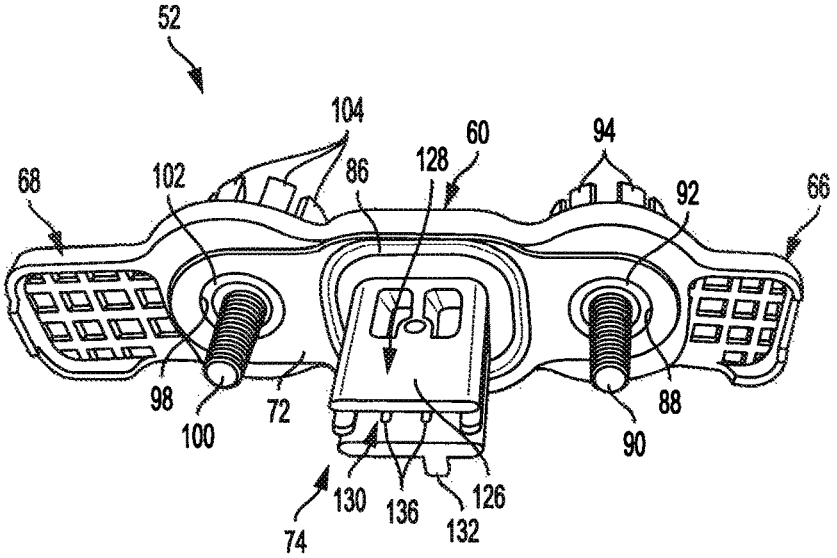
FIG. 3 is a bottom perspective view of the example HVIL plug shown in FIG. 1, in accordance with the principles of the present application.
Figure 4:
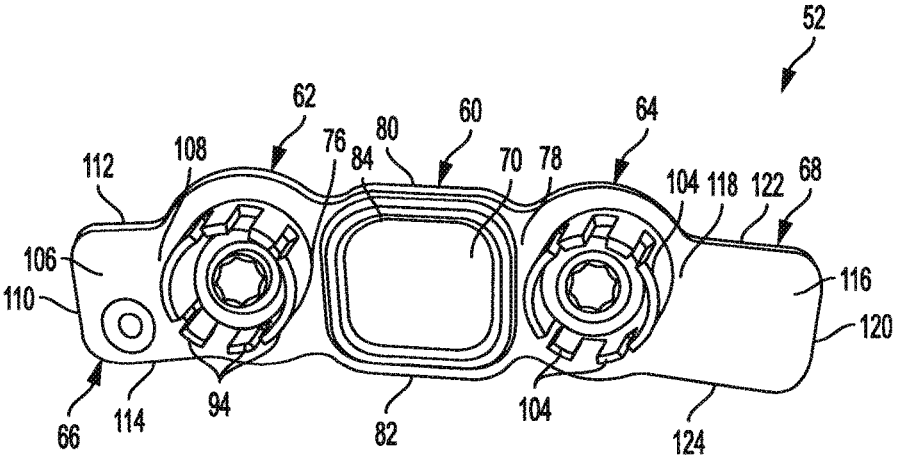
FIG. 4 is a top perspective view of the HVIL plug shown in FIG. 3, in accordance with the principles of the present application.

As shown in FIGS. 3 and 4, in the example embodiment, HVIL plug assembly 52 generally includes a main body 60 coupled between opposed fastener members 62 and 64. A first flange 66 extends outwardly from fastener member 62, and a second flange 68 extends outwardly from fastener member 64. Together, main body 60, fastener members 62, 64, and flanges 66, 68 define an outer surface 70 and an opposite inner surface 72 of the HVIL plug assembly 52. As shown in FIG. 3, a jumper 74 is coupled to and extends outwardly from the inner surface 72 of main body 60. In one example, main body 60, fastener members 62, 64, flanges 66, 68, and jumper 74 are integrally formed as a single piece or component.

In the example embodiment, main body 60 includes a first side 76, a second side 78, a third side 80, and a fourth side 82. In one example, main body 60 is generally rectangular. In another example, main body 60 is generally square. However, main body 60 can have any suitable shape that enables HVIL plug assembly 52 to function as described herein. Main body outer surface 70 includes a structural rib 84 extending outwardly therefrom generally about a perimeter of the main body 60. A seal 86 is coupled to and extends outwardly from main body inner surface 72. Seal 86 is configured to engage outer surface 38 of access cover 26 about the receiving aperture 42 to prevent debris or other contaminants (e.g., liquid or vapor) from entering housing 22 via aperture 42. Main body first side 76 is coupled to fastener member 62, and main body second side 78 is coupled to fastener member 64.

Fastener member 62 is coupled to main body first side 76 and is a generally solid member having a fastener aperture 88 formed therethrough configured to receive a fastener 90 (e.g., a bolt). An annular member 92 (see FIG. 3) may be disposed within the fastener aperture 88 and similarly configured to receive fastener 90. In the example embodiment, annular member 92 is formed from a rigid and/or durable material (e.g., metal) such that damage is prevented to fastener member 62 during repeated insertion and removal of fastener 90 into and out of fastener aperture 88. Additionally, a plurality of tabs 94 are coupled to outer surface 70 of fastener member 62 and extend outwardly therefrom. Tabs 94 are configured to retain the fastener 90 to fastener member 62 when HVIL plug assembly 52 is uncoupled. As shown in the illustrated example, tabs 94 may be arranged in a circular or generally circular fashion about fastener aperture 88 and annular member 92. Additionally, tabs 94 can include ramped flanges (not shown) that allow the tabs 94 to flex outward when fastener 90 is inserted but to retain and prevent backing out of the fastener 90 from aperture 88.

Fastener member 64 is similar in structure to fastener member 62 and is coupled to main body second side 78. A fastener aperture 98 is formed through a generally solid member and is configured to receive a fastener 100 (e.g., a bolt). An annular member 102 (see FIG. 3) may be disposed within the fastener aperture 98 and similarly configured to receive fastener 100. In the example embodiment, annular member 102 is formed from a rigid and/or durable material (e.g., metal) such that damage is prevented to fastener member 64 during repeated insertion and removal of fastener 100 into and out of fastener aperture 98. Additionally, a plurality of tabs 104 are coupled to outer surface 70 of fastener member 64 and extend outwardly therefrom. Similar to tabs 94, tabs 104 are configured to retain fastener 100 within fastener aperture 98 and may be arranged in a circular or generally circular fashion about fastener aperture 98 and annular member 102.

Flange 66 extends outwardly from fastener member 62 and generally includes a body 106 having a first side 108, a second side 110, a third side 112, and a fourth side 114. Flange 66 is oriented such that it covers a fastener 32*a* (FIG. 2) when HVIL plug assembly 52 is inserted through access cover 26 and connected to HVIL connector 50. In this way, fastener 32*a* is inaccessible and cannot be removed to enable access inside housing 22 without first removing HVIL plug assembly 52, which breaks the circuit and removes the high voltage from the region of electrical device 14.

Similarly, flange 68 extends outwardly from fastener member 64 and generally includes a body 116 having a first side 118, a second side 120, a third side 122, and a fourth side 124. Flange 68 is oriented such that it covers a fastener 32*b* (FIG. 2) when HVIL plug assembly 52 is inserted through access cover 26 and connected to HVIL connector 50. In this way, in order to remove cover 26 and access the electrical components inside housing 22, HVIL plug assembly 52 must first be removed, which breaks the circuit and removes the high voltage from the region of the electrical device 14.

As shown in FIG. 3, jumper 74 is coupled to and extends outwardly from the inner surface 72 of main body 60. Jumper 74 generally includes a body 126 having an outer surface 128 and defining an interior cavity 130. A key 132 (FIG. 3) extends outwardly from jumper body outer surface 128 and is configured to be received in a corresponding notch 134 (FIG. 2) formed with receiving aperture 42. In this way, key 132 and notch 134 require that HVIL plug assembly 52 is inserted through receiving aperture 42 in a proper orientation. However, it will be appreciated that various other orientation or positioning features may be utilized that enables HVIL system 28 to function as described herein. Main body 60 and interior cavity 130 include electrical pins or connection features 136 configured to establish circuit continuity when HVIL plug assembly 52 is connected to HVIL connector 50.

In operation, as shown in FIG. 1, HVIL plug assembly 52 is inserted through access cover receiving aperture 42 such that key 132 is received within notch 134. Fasteners 90, 100 are inserted through respective fasteners apertures 88, 98 as well as though respective fastener apertures 44, 46 formed in access cover 26. Accordingly, HVIL plug assembly 52 is coupled to access cover 26 such that plug inner surface 72 is disposed against cover outer surface 38 and seal 86 is sealed against outer surface 38 about receiving aperture 42 and notch 134. In this orientation, shown in FIG. 1, flange 66 extends outwardly and covers or prevents access to cover fastener 32*a*, and flange 68 extends outwardly and covers or prevents access to cover fastener 32*b* (FIG. 2). In this way, fasteners 32*a*, 32*b* cannot be removed to remove access cover 26 without first removing HVIL plug assembly 52, which will break the circuit continuity and cause the high voltage to be removed from electrical device 14.

To access the electrical components within housing 22, HVIL plug assembly 52 is first removed by removing fasteners 90, 100. However, although the example embodiment describes HVIL plug assembly 52 coupled to cover 26 via fasteners 90, 100, it will be appreciated that various other systems may be utilized to removably couple HVIL plug assembly 52 to cover 26 such as, for example, by clips, magnets, etc. Once uncoupled, HVIL plug assembly 52 is disconnected from HVIL connector 50, thereby breaking the circuit continuity and removing high voltage from the electrical device 14. With HVIL plug assembly 52 removed, cover fasteners 32*a*, 32*b* are exposed and can be removed along with fasteners 30, and access cover 26 can thus be removed from housing 22. Once cover 26 is removed, a user can access the electrical components disposed within housing 22 without risk of voltage being on HV circuit 16. Once maintenance is complete, cover 26 and HVIL plug assembly 52 are assembled in reverse order to once again establish circuit continuity on HV circuit 16.

FIGS. 5-8 illustrate an alternative arrangement of electrical device 14 and HVIL system 28 where like reference numerals indicate like parts. The arrangement in FIGS. 5-8 is similar to that shown in FIGS. 1-4 except electrical device 14 includes connections 200 to the vehicle electric motors (not shown), and HVIL system 28 includes an HVIL plug assembly 252 having a single flange covering a fastener to prevent access to electrical device 14.

In the example embodiment, electrical device 14 is configured to act as a power inverter module and convert DC electrical power to AC electrical power for delivery to one or more AC power consumers, as well as AC electrical power back to DC electrical power for consumption. Electrical device 14 generally includes a housing 222 configured to house various electrical components such as connections between the output of a power inverter and the wires that deliver power to a consuming device such as an electric motor (not shown). However, electrical device 14 can include various other electrical components for various other applications.

In the example embodiment, electrical device 14 includes an access cover 226 removably coupled to housing 222 to enable access to the connectors 200 or other electrical components connected to the high voltage circuit 16 within housing 222, when service is required. However, in order to safely service the components and prevent electrical shock, the electrical device 14 includes high voltage interlock (HVIL) system 28 configured to remove high voltage from the electrical device 14 before a person can access the electrical components. As described herein, HVIL system 28 automatically disconnects battery pack 12 from the high voltage battery system 10 before access cover 226 can be removed from housing 222 in order to access a desired electrical component therein.

Figure 5:
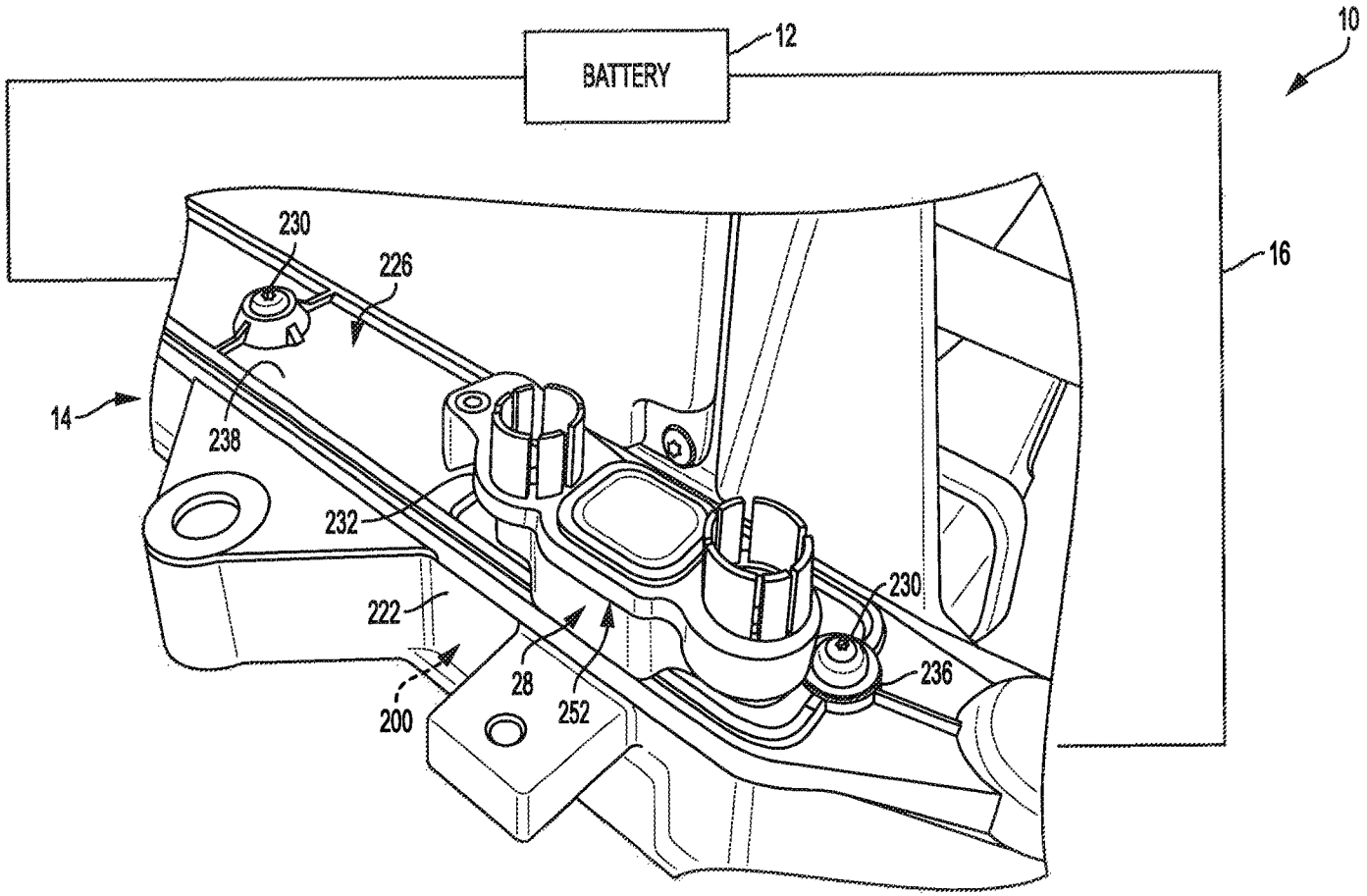
FIG. 5 is a perspective view of another example electrical device having an HVIL system in accordance with the principles of the present application.
Figure 6:
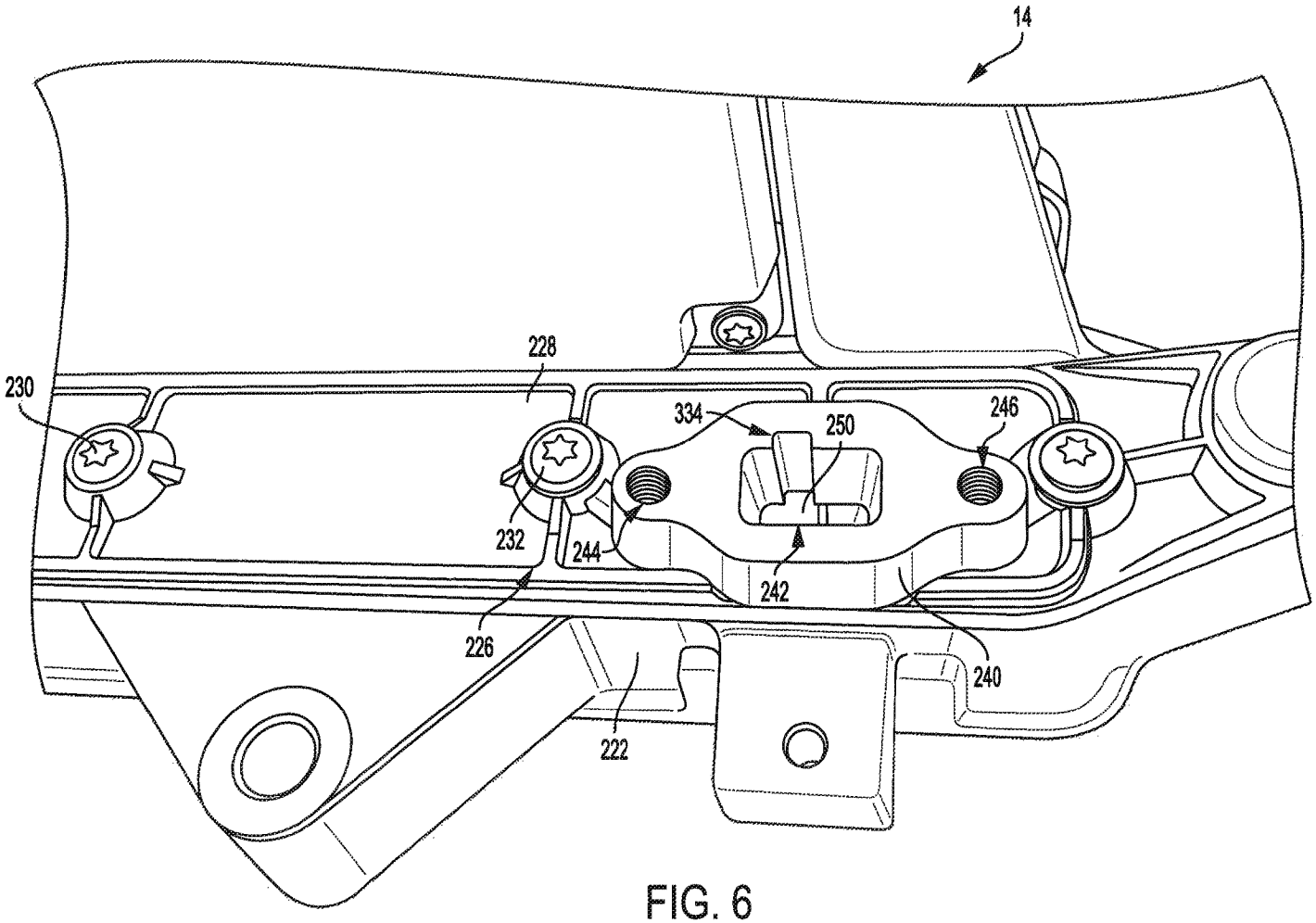
FIG. 6 is a perspective view of the electrical device shown in FIG. 5 with a plug of the HVIL system removed, in accordance with the principles of the present application.

As shown in FIGS. 5 and 6, access cover 226 is removably coupled to housing 222 by a plurality of fasteners 230, 232. Access cover 226 includes a plurality of apertures 236 formed therein configured to receive one of the fasteners 230, 232. Moreover, an outer surface 238 of access cover 226 includes a projection or seat 240 extending therefrom (see FIG. 6) sized and shaped to receive a portion of the HVIL system 28. Additionally, a receiving aperture 242 and fastener apertures 244, 246 are formed through the cover and configured to receive portions of the HVIL system 28 therethrough, as described herein in more detail.

With additional reference to FIGS. 7 and 8, HVIL system 28 will be described in more detail. As shown in the figures, HVIL system 28 generally includes an HVIL connector 250 configured to matingly engage an HVIL plug assembly 252 to establish HVIL circuitry continuity. The HVIL connector 250 is disposed within the device housing 222 and is electrically connected to the high voltage interlock circuit 16. The receiving aperture 242 (FIG. 6) formed through access cover 226 is configured to receive HVIL plug assembly 252 therein. When HVIL plug assembly 252 is inserted through receiving aperture 242 and coupled to HVIL connector 250, the circuit is completed and high voltage is supplied from battery pack 12 to the various electrical devices 14 via high voltage circuit 16. When HVIL plug assembly 252 is disconnected from HVIL connector 250, the HVIL circuit continuity is broken, and high voltage is subsequently removed from the region of the electrical device 14 such that service may be safely performed the region.

Figure 7:
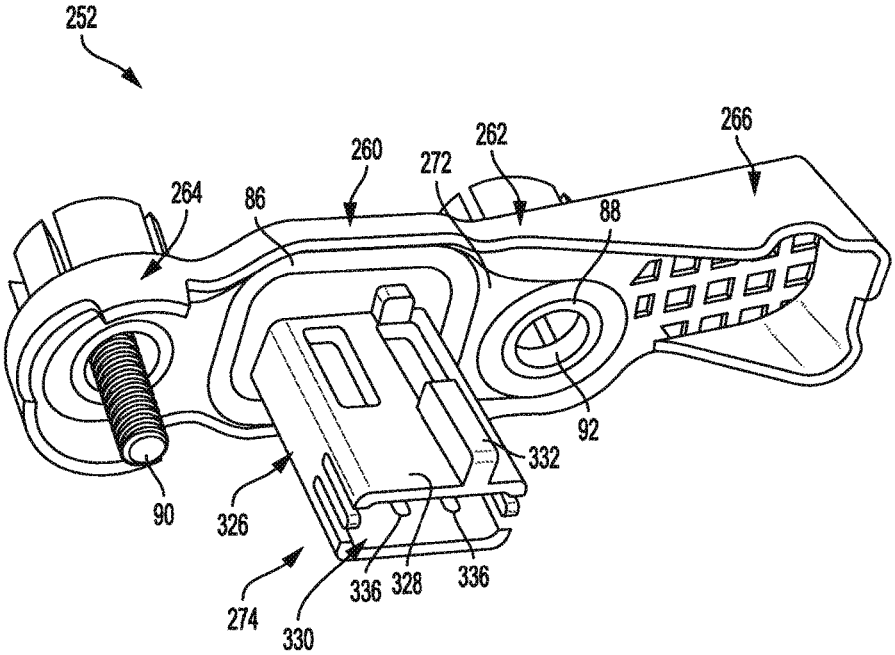
FIG. 7 is a bottom perspective view of the example HVIL plug shown in FIG. 5, in accordance with the principles of the present application.
Figure 8:
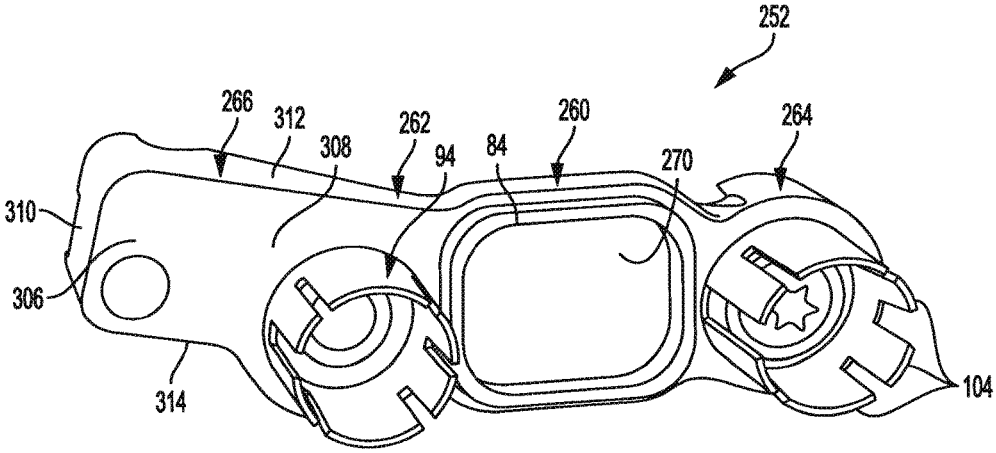
FIG. 8 is a top perspective view of the HVIL plug shown in FIG. 7, in accordance with the principles of the present application.

As shown in FIGS. 7 and 8, in the example embodiment, HVIL plug assembly 252 generally includes a main body 260 coupled between opposed fastener members 262 and 264. Unlike HVIL plug assembly 52, the HVIL plug assembly 252 includes only a single flange 266 extending outwardly from fastener member 262. HVIL plug assembly 252 defines an outer surface 270 and an opposite inner surface 272, and a jumper 274 (FIG. 7) is coupled to and extends outwardly from the inner surface 272 of main body 260. In one example, main body 260, fastener members 262, 264, flange 266, and jumper 274 are integrally formed as a single piece or component.

Flange 266 extends outwardly from fastener member 262 and generally includes a body 306 having a first side 308, a second side 310, a third side 312, and a fourth side 314. Flange 266 is oriented such that it covers fastener 232 (FIG. 6) when HVIL plug assembly 252 is inserted through access cover 226 and connected to HVIL connector 250. In this way, fastener 232 is inaccessible and cannot be removed to enable access inside housing 222 without first removing HVIL plug assembly 252, which breaks the circuit and removes the high voltage from the region of electrical device 14.

As shown in FIG. 3, jumper 274 is coupled to and extends outwardly from the inner surface 272 of main body 260. Jumper 274 generally includes a body 326 having an outer surface 328 and defining an interior cavity 330. A projection or key 332 (FIG. 7) extends outwardly from jumper body outer surface 328 and is configured to be received in a corresponding notch 334 (FIG. 6) formed with receiving aperture 242. In this way, key 332 and notch 334 require that HVIL plug assembly 252 is inserted through receiving aperture 242 in a proper orientation. However, it will be appreciated that various other orientation or positioning features may be utilized that enables HVIL system 28 to function as described herein. Main body 260 and interior cavity 330 include electrical pins or connection features 336 configured to establish circuit continuity when HVIL plug assembly 252 is connected to HVIL connector 250.

In operation, as shown in FIG. 5, HVIL plug assembly 252 is inserted through access cover receiving aperture 242 such that key 332 is received in notch 334. Fasteners 90, 100 are inserted through respective fasteners apertures 88, 98 as well as though respective fastener apertures 244, 246 formed in access cover 226. Accordingly, HVIL plug assembly 252 is coupled to access cover 226 such that plug inner surface 272 is disposed against cover outer surface 238 and seal 86 is sealed against outer surface 238 about receiving aperture 242 and notch 334. In this orientation, flange 266 extends outwardly and covers or prevents access to cover fastener 232*a*. In this way, fastener 232 and thus cover 226 cannot be removed without first removing HVIL plug assembly 252, which will break the circuit continuity and cause the high voltage to be removed from electrical device 14.

To access the electrical components within housing 222, HVIL plug assembly 252 is first removed by removing fasteners 90, 100 (FIG. 5). Once uncoupled, HVIL plug assembly 252 is disconnected from HVIL connector 250, thereby breaking the circuit continuity and removing high voltage from the electrical device 14. With HVIL plug assembly 252 removed (see FIG. 6), cover fastener 232 is exposed and can be removed along with fasteners 230, and access cover 226 can then be removed from housing 222. Once cover 226 is removed, a user can access the electrical components disposed within housing 222 without risk of voltage being on HV circuit 16. Once maintenance is complete, cover 226 and HVIL plug assembly 252 are assembled in reverse order to once again establish circuit continuity on HV circuit 16.

Described herein are systems and methods for preventing access to electrical devices on high voltage circuits without first breaking the circuit continuity to remove high voltage from the electrical devices. In particular, a removable access cover provides access to electrical components housed in a housing of the electrical device. The access cover is coupled to the housing by one or more fasteners, which are in turn covered by a plug of an HVIL system. When coupled to the access cover to establish electrical continuity in the high voltage circuit, the HVIL plug is positioned over and prevents removal of the one or more fasteners. This prevents removal of the access cover while high voltage is on the circuit. When maintenance is required, the HVIL plug must first be removed in order to open the cover and access the electrical components. However, removal of the HVIL plug breaks the circuit continuity, thereby removing high voltage from the electrical device and providing a safer environment for maintenance of the electrical device.

It will be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. A high voltage interlock (HVIL) plug assembly configured to establish circuit continuity when coupled to a connector in a high voltage interlock circuit and prevent circuit continuity when decoupled from the connector, the HVIL plug assembly comprising:

a main body having an outer surface and an inner surface configured to be disposed against an access cover of an electrical device, wherein removal of the access cover enables access to components in the electrical device electrically connected to the high voltage interlock circuit;

a jumper coupled to the main body and configured to extend through a receiving aperture in the access cover to couple to the connector and establish circuit continuity when the main body is coupled to the access cover; and a flange extending from the main body, wherein when the main body is coupled to the access cover, the flange covers and prevents access to a fastener that couples the access cover to a housing of the electrical device such that the main body must be uncoupled and removed from the access cover in order to remove the fastener and enable removal of the access cover.

2. The HVIL plug assembly of claim 1, further comprising a second flange extending from the main body, wherein when the main body is coupled to the access cover, the second flange covers and prevents access to a second fastener that couples the access cover to the housing such that the main body must be uncoupled and removed from the access cover in order to remove the second fastener and enable removal of the access cover.

3. The HVIL plug assembly of claim 1, further comprising a fastener member disposed between the main body and the flange, the fastener member including a fastener aperture configured to receive a plug fastener to couple the main body to the access cover.

4. The HVIL plug assembly of claim 2, further comprising:

a first fastener member disposed between the main body and the flange, the first fastener member including a first fastener aperture configured to receive a first plug fastener to couple the main body to the access cover; and a second fastener member disposed between the main body and the second flange, the second fastener member including a second fastener aperture configured to receive a second plug fastener to further couple the main body to the access cover.

5. The HVIL plug assembly of claim 3, further comprising an annular member disposed within the fastener aperture and configured to receive the plug fastener.

6. The HVIL plug assembly of claim 1, wherein the jumper includes a jumper body and a key extending outwardly therefrom, the key configured to be received by a notch formed in the access cover receiving aperture to provide a proper orientation of the main body when the jumper is inserted through the receiving aperture.

7. The HVIL plug assembly of claim 1, wherein the main body inner surface includes a seal configured to seal around the receiving aperture when the main body is coupled to the access cover.

8. The HVIL plug assembly of claim 7, further comprising a structural rib extending outwardly from the main body outer surface.

9. The HVIL plug assembly of claim 3, further comprising a plurality of tabs arranged about a perimeter of the fastener aperture and extending outwardly from an outer surface of the fastener member, the plurality of tabs configured to retain the plug fastener within the fastener aperture.

10. An electrical device configured to electrically couple to a high voltage interlock circuit, the electrical device comprising:

a housing configured to house at least one electrical component electrically coupled to the high voltage interlock circuit;

an access cover removably coupled to the housing by a fastener, wherein the access cover is removed to provide access to the at least one electrical component in the housing, the access cover having a receiving aperture formed therethrough; and a high voltage interlock (HVIL) system configured to selectively break continuity of the high voltage interlock circuit and remove high voltage from the electrical device, the HVIL system comprising:

an HVIL connector disposed within the housing and electrically connected to the high voltage interlock circuit; and an HVIL plug assembly removably coupled to the HVIL connector, wherein the HVIL plug assembly establishes circuit continuity when coupled to the HVIL connector, and breaks circuit continuity when uncoupled from the HVIL connector, the HVIL plug assembly comprising:

a main body removably coupled to the access cover and having an outer surface and an inner surface configured to be disposed against the access cover;

a jumper coupled to the main body and configured to extend through the access cover receiving aperture to couple to the connector and establish circuit continuity when the main body is coupled to the access cover; and a flange extending from the main body, wherein when the main body is coupled to the access cover, the flange covers and prevents access to the fastener that couples the access cover to the housing such that the main body must be uncoupled and removed from the access cover in order to remove the fastener and enable removal of the access cover.

11. The electrical device of claim 10, further comprising a fastener member disposed between the main body and the flange, the fastener member including a fastener aperture configured to receive a plug fastener to couple the main body to the access cover.

12. The electrical device of claim 11, wherein the main body, the flange, the fastener member, and the jumper are integrally formed into a single component.

13. The electrical device of claim 10, further comprising a second flange extending from the main body, wherein when the main body is coupled to the access cover, the second flange covers and prevents access to a second fastener that couples the access cover to the housing such that the main body must be uncoupled and removed from the access cover in order to remove the second fastener and enable removal of the access cover.

14. The electrical device of claim 13, further comprising:

a first fastener member disposed between the main body and the flange, the first fastener member including a first fastener aperture configured to receive a first plug fastener to couple the main body to the access cover; and a second fastener member disposed between the main body and the second flange, the second fastener member including a second fastener aperture configured to receive a second plug fastener to further couple the main body to the access cover.

15. The electrical device of claim 14, wherein the main body, the flange, the second flange, the first fastener member, the second fastener member, and the jumper are integrally formed into a single component.

16. The electrical device of claim 14, further comprising:

a first annular member disposed within the first fastener aperture and configured to receive the first plug fastener; and a second annular member disposed within the second fastener aperture and configured to receive the second plug fastener.

17. The electrical device of claim 10, wherein the jumper includes a jumper body and a key extending outwardly therefrom, the key configured to be received by a notch formed in the access cover receiving aperture to provide a proper orientation of the main body when the jumper is inserted through the receiving aperture.

18. The electrical device of claim 17, wherein the main body inner surface includes a seal configured to seal around the receiving aperture and key when the main body is coupled to the access cover.

19. The electrical device of claim 11, further comprising a plurality of tabs arranged about a perimeter of the fastener aperture and extending outwardly from an outer surface of the fastener member.

* * * * *